United States Patent [19]

Bock

[11] 4,128,083

[45] Dec. 5, 1978

[54] GAS CUSHIONED FREE PISTON TYPE ENGINE

[76] Inventor: Rudolf Bock, Palmerstrasse 9, 7031 Holzgerlingen, Fed. Rep. of Germany

[21] Appl. No.: 809,999

[22] Filed: Jun. 24, 1977

[30] Foreign Application Priority Data

Jul. 3, 1976 [DE] Fed. Rep. of Germany ..... 2630004

[51] Int. Cl.[2] ..... F02B 71/00

[52] U.S. Cl. ..... 123/46 R; 60/595; 417/364; 123/56 BC; 123/47 A

[58] Field of Search ..... 123/46 R, 47, 47 A, 123/56 BC, 46 A, 61 R, 62, 139 A, 139 AJ, 139 AT, 139 BF; 60/595, 596; 417/364

[56] References Cited

U.S. PATENT DOCUMENTS

| | | | |
|---|---|---|---|
| 1,774,105 | 8/1930 | Neldner | 123/56 BC |
| 2,825,319 | 3/1958 | Harrer | 123/56 BC |
| 2,963,008 | 12/1960 | Waldrop | 123/46 A |
| 3,089,305 | 5/1963 | Hobbs | 60/595 |

FOREIGN PATENT DOCUMENTS

| | | | |
|---|---|---|---|
| 363022 | 12/1931 | United Kingdom | 60/595 |

*Primary Examiner*—Charles J. Myhre
*Assistant Examiner*—Jeffrey L. Yates
*Attorney, Agent, or Firm*—Michael J. Striker

[57] ABSTRACT

A gas cushioned free piston type engine comprises two oppositely arranged combustion cylinders and a pair of pistons reciprocably mounted therein, which are rigidly connected to each other by a common piston rod. The engine includes further a pump cylinder provided in a central part of the engine located between the two combustion cylinders, a pump piston having opposite faces impingeable by fluid, fixed to the piston rod and dividing the pump cylinder into a pair of pump cylinder chambers, a common suction chamber and a common pressure chamber, which, together with inlet valves and outlet valves, are arranged in the central part of the engine.

16 Claims, 4 Drawing Figures

III
III
44
25
43
25
24
18
62
26
39
45
47
16
14
11
38
30
40
65
31
37
42
29
28
17
33
47
40
41
37
42
10
34
13
36
46
58

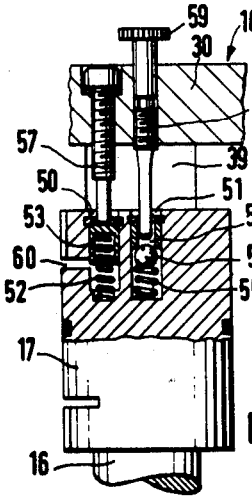
FIG. 4
FIG. 3
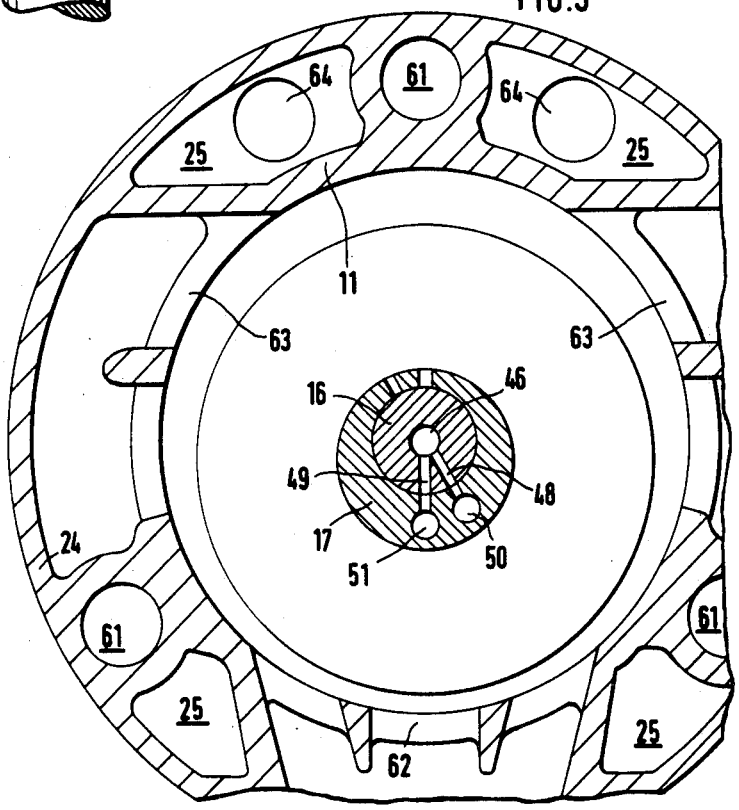

GAS CUSHIONED FREE PISTON TYPE ENGINE

BACKGROUND OF THE INVENTION

The present invention relates to a gas cushioned free piston type engine with two oppositely arranged combustion cylinders, the pistons of which are rigidly connected by a common piston rod. The engine includes further a hydraulic pump cylinder arranged in a central part of an engine with a pump piston, the opposite faces of which are impingeable by fluid, and which is fixed on the aforementioned common piston rod, and a common suction chamber as well as a common pressure chamber, which, together with suction and outlet valves for the two pump sylinder chambers, are arranged in a central part of the engine located between the two combustion cylinders.

A gas cushioned free piston type engine of the aforementioned kind is already disclosed in the U.S. Pat. No. 3,089,305. This engine has, as compared with other engines of the aforementioned type, as for instance disclosed in DT-OS 1,576,890, the advantage that practically all control devices are concentrated in a center part of the engine. It has already been proven that the commercial use of such engines, which operate with high compression and high efficiency and which have the essential advantage not to require a crankshaft, will decisively depend on how compact and reliable in operation such a machine may be produced.

SUMMARY OF THE INVENTION

It is an object of the present invention to provide a gas cushioned free piston type engine of compact construction and with a minimum weight per horse power output.

It is a further object of the present invention to provide an engine of the aforementioned kind, which is composed of relatively few and simple parts and which will operate trouble free during extended use.

With these and other objects in view, which will become apparent as the description proceeds, the gas cushioned free piston type engine according to the present invention mainly comprises a pair of oppositely arranged combustion cylinders axially spaced from each other, a central engine part having an inner section projecting with opposite end portions respectively into the combustion cylinders radially inwardly spaced therefrom, piston means comprising a pair of pistons respectively arranged in the combustion cylinders, common piston rod means rigidly connecting the pair of pistons of the piston means, pump piston means fixedly mounted on the piston rod means, in which one of the aforementioned means is eccentrically arranged with respect to the other of these means, a pump cylinder in which the pump piston means is reciprocable, in which this pump cylinder is arranged in the inner section of the central part, in which the opposite end portions of the inner section of the central part have a smaller outer diameter than the inner diameter of each of the hollow pistons of the pistons means and in which the stroke of the latter is such that the end portions of the inner section of the central part respectively extend into open ends of the piston during reciprocation of the latter.

The engine includes further a common suction chamber into which fluid is sucked by the pump piston means and a common pressure chamber. The common suction chamber and the common pressure chamber are arranged in a portion of the central part of the engine which projects radially beyond the outer diameter of the combustion cylinders. The common pressure chamber is located radially outwardly of the common suction chamber and has a volume considerably greater than that of the suction chamber. Preferably, the common suction chamber and the common pressure chamber are constructed as concentric annular chambers. These chambers are preferably partly limited by elastically yieldable walls which separate the two chambers from gas filled damping chambers. The control devices for the fuel injection are preferably arranged in the pump piston and connected through channels formed in the piston rod with injection valves, which are respectively arranged at the front faces of the pistons which are reciprocably mounted in the combustion cylinders. For this purpose the pump piston is advantageously eccentrically arranged on the piston rod.

The combustion cylinders are preferably connected to the central part of the engine and the unit comprising the two combustion cylinders and the central engine part is preferably arranged reciprocably in axial direction in a stationary outer housing, whereby according to the invention the outer section of the reciprocable central part forms with outer surfaces thereof extending transverse to the movement thereof, together with oppositely arranged walls of the stationary housing, outer auxiliary feed chambers which communicate with the air suction chambers of the two combustion cylinders.

A gas cushioned free piston type engine according to the invention can be built extremely compact and satisfies therefore the main prerequisite of an engine of the type which can be built into even small appliances. The two combustion pistons may, during their strokes, move over a large portion of the central part of the engine, whereby a compact construction of the engine is derived, as so far has not been obtained in any of the known engines of this type. In connection with the compact construction, the further advantage is derived that a special cooling circuit with special cooling means becomes unnecessary and that the oil used for the pump part of the machine, which at the same time provides the fuel for the combustion cylinders, may be used for cooling the engine. Thereby, the conduits for the common suction chamber may be guided over cooling chambers, which are formed between the combustion cylinders and a jacket surrounding the latter.

Since diesel oil is used as power transmission medium which as fuel is continuously used up and replaced by new oil, the engine according to the present invention does not require an expensive aging resistant oil. It is sufficient if the diesel oil used has a viscosity which may be advantageously used for medium pump pressure. The amount of oil circulation in the engine is so large so that the total heat created by the engine may be conducted away, which heat is, due to the derived high compression, comparatively small.

The concentric arrangement of the suction chamber and the pressure chamber has the further advantage that despite the compact construction a relatively large pressure chamber can be formed, which at the same time is constructed to dampen the pressure shocks, produced in the hydraulic fluid by the pump piston, directly adjacent the source of such shocks. The reciprocable mounting of the central part of the engine with the combustion cylinders connected thereto constitutes a further shock equalization factor produced by the engine according to the invention, which simultaneously is used for an improved scavenging of the combustion cylinders by means of the scavenging air furnished by the auxiliary chambers of changing volume.

The common suction chamber and the common pressure chamber of the engine have the advantage that the accumulation and the withdrawal of the oil serving as working medium occurs twice during the to-and-fro movement of the pump piston and the thereby moved amount of oil is correspondingly reduced so that the pulsation damping arrangement may correspondingly act in a better manner. The arrangement of the pulsation damping members directly adjacent the source of the pressure shocks contributes essentially to a substantially noiseless operation of the engine.

The gas cushioned free piston type engine is produced with a minimum of individual parts. Protection against rotation of the driven system, comprising the two rigidly connecting pistons and the pump piston arranged therebetween, is accomplished by the eccentric arrangement of these machine parts without requiring any additional elements. Preferably, the pump piston is eccentrically arranged on the common piston rod, which results in the additional advantage, that in the wider pump piston region on each end face of the pump piston two bores parallel to the axis of the piston rod may be arranged for the reception of a spring biased plunger of small mass, respectively, of an overflow valve with a spring biased closure member of small mass, whereby the plunger and the closure member cooperate respectively with stop bolts, which preferably are adjustably arranged in the central part of the engine. The engine permits thereby an extremely simple actuation of the fuel injection.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 3 is a partial cross-section of the engine along the line III—III of FIG. 2; and FIG. 4 is a longitudinal section of the control means for the fuel injection for one of the two combustion cylinders, and drawn to an enlarged scale.

DESCRIPTION OF THE PREFERRED EMBODIMENTS

Figure 1:
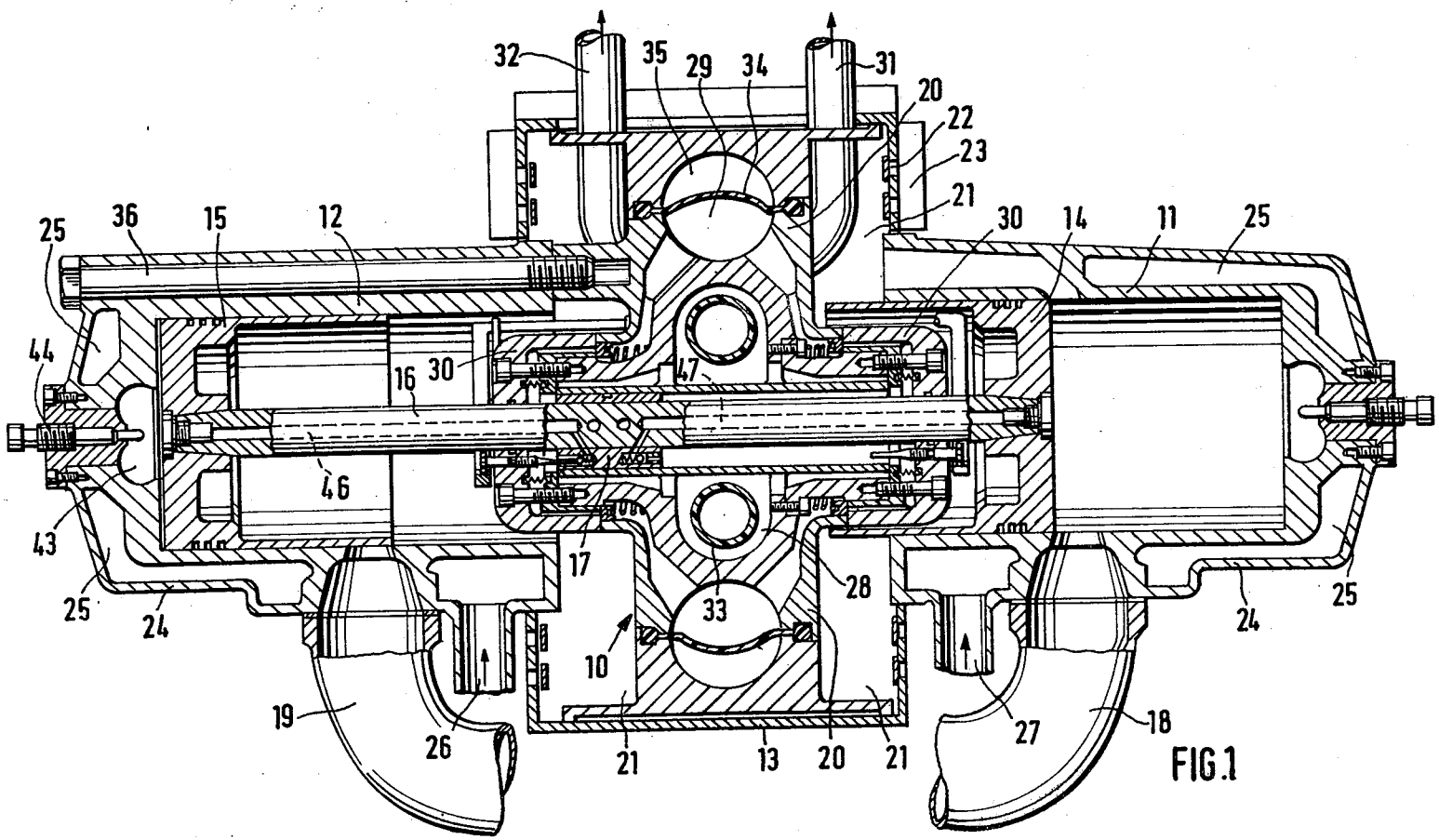
FIG. 1 is an axially sectioned overall illustration of the gas cushioned free piston type engine according to the present invention.

FIG. 1 illustrates the symmetrical and compact construction of the gas cushioned free piston type engine according to the present invention, in which a central part 10 of the engine with the two combustion cylinders 11 and 12, arranged to opposite sides of the central part and fixedly connected thereto, are movable in axial direction of the cylinders in a stationary housing 13. The pistons 14 and 15 which are reciprocably arranged in the two combustion cylinders 11 and 12 are rigidly connected to each other by a common piston rod 16, to which a pump piston 17, the opposite faces are impingeable by fluid, is eccentrically fixed.

FIG. 1 shows further the two exhaust discharge sockets 18 and 19 of the two combustion cylinders 11 and 12. The side faces of an outer section 20 of the central part, which extend transverse to the movement thereof, form, with the opposite walls of the stationary housing 13, auxiliary chambers 21 for scavenging air which is sucked into the chamber 21 over openings 22 in the stationary housing and filters 23 extending transverse to these openings. An outer jacket 24 surrounds the two combustion cylinders 11 and 12 to form between the jacket and the cylinders cooling chambers 25, which are flown through by the oil serving as conveying means and fuel on its path from the inlet channels 26 and 27 to the common suction chamber 28 in the central part 10 of the engine.

As shown in FIG. 1, the inner sections 30 of the central part 10 has a pair of oppositely projecting portions, which during reciprocation of the pistons 14 and 15, will extend into the two hollow and rearwardly open pistons 14 and 15. FIG. 1 shows further the concentric arrangement of the common suction chamber 28 and the common pressure chamber 29 in the central part 10 and the oil discharge conduits 31 and 32 which communicate with the common pressure chamber 29. A nitrogen filled elastic annular body 33, serving as a shock absorbing body, is arranged in the common annular suction chamber 28, whereas the pressure chamber 29, radially outwardly of the suction chamber 28 and concentric thereto and having an essentially larger volume, is divided by an elastic membrane 34, which along two parallel edges is clamped in the central part 10, in the actual pressure chamber filled with oil and a nitrogen filled annular damping chamber 35.

The engine according to the present invention operates according to the two-tact principle. As shown in FIG. 1 the auxiliary chambers 21 are connected with the combustion cylinders, whereas the rear side of each piston 14 and 15 serves to convey the scavenging air. Due to the mounting of the central part 10 of the engine, together with the combustion cylinders 11 and 12 connected by the screws 36 thereto, in the stationary housing 13 for oscillatory movement relative thereto, the connecting conduits, which lead to the connection spaces 26, 27, 31 and 32, are constructed as movable conduits, through which the diesel oil passes.

The two pistons 14 and 15 which are rigidly connected by the piston rod 16 form together with the pump piston 17 a first movable unit. The central part 10 of the engine with the combustion cylinders 11 and 12 connected thereto form a second movable unit, which due to their movable mounting in the stationary housing 13, may oscillate in opposition to the first unit. The oscillating speeds and the length of the oscillating paths are inverse to the respective masses of the two systems.

By means of the auxiliary chambers 21 it is possible to bring the amount of scavenging air for instance up to 1.3 times the piston stroke volumes, which will result in a perfect, and for the efficiency of the engine important, scavenging of the combustion cylinders 11 and 12.

The construction of the pump parts of the machine will now be further described in connection with FIG. 2. The oil passes from the inlet 26 into the cooling chambers 25 between the outer jacket 24 and the combustion cylinder 11 and over a connection conduit, not shown in the drawing, into the common annular suction chamber 28 in the central part 10 of the engine. From there the oil passes over the suction channels 37 and a suction valve 38, constructed as an annular valve, in the pump cylinder chamber 39. According to the symmetrical construction of the engine there is a corresponding pump cylinder chamber in the other half of the engine. The pump cylinder chamber 39 is connected over channels 40 and an outlet valve 41, which is likewise constructed as an annular valve, and over further channels 42, the cross-sections of which increase in the direction of flow, to the pressure chamber 29, which is in part limited by the elastic membrane 34, from where discharge of oil takes place over the oil discharge channels 31 and 32.

Figure 2:
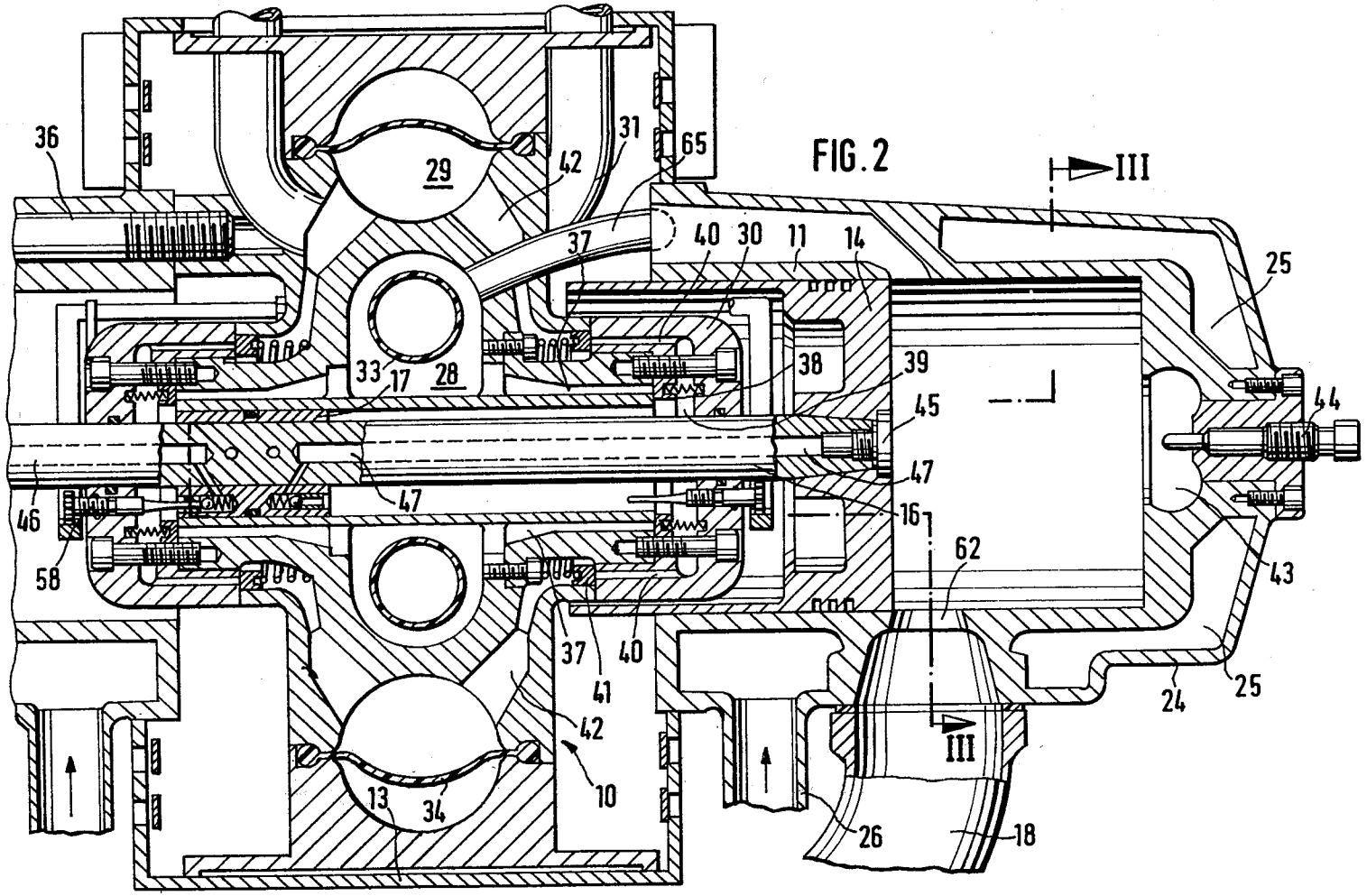
FIG. 2 is a partial cross-section of the engine shown in FIG. 1 and drawn to an enlarged scale.

FIG. 2 shows also a turbulance chamber 43 in the outer portion of the combustion cylinder 11 into which a glow plug 44, insertable from the outside, projects for preheating the fuel. An injection nozzle 45 is arranged centrally in the end of the piston rod 16, and fuel is supplied to the injection nozzle 45 from the region of the pump piston 17 through a central, longitudinal bore 46 in the piston rod 16. A second central longitudinal bore 47, which however is not connected to the central bore 46, extends from the region of the pump piston 17 to the opposite side to the piston 15 of the engine.

The cross-section of FIG. 3 shows the cross-section of the pump piston 17, which is eccentrically mounted on the piston rod 16. FIG. 3 shows also that the central longitudinal bore 46 through the piston rod 16 communicates through two radially extending channels 48 and 49 respectively with two bores 50 and 51 extending parallel to the axis of the piston rod 16 and arranged in the wider part of the pump piston 17.

As shown in FIG. 4, the two bores 50 and 51 are blind bores which extend from one end face of the pump piston 17 into the latter. It is to be understood that two corresponding bores extend from the other end face of the pump piston 17 into the latter, which are respectively connected over radial channels with the central longitudinal bore 47 through the piston rod 16.

A plunger 53 of small mass is arranged in the bore 50 movable against the force of a return spring 52, whereas an overflow valve 54, with a ball-shaped closure member 56 of small mass which is movable against the force of a return spring 55, is arranged in the bore 51. The plunger 53 cooperates with a stop bolt 57 which is mounted, preferably adjustably in axial direction, in the inner section 30 of the central part 10 of the engine, whereas a stop bolt 58, which is likewise adjustable in axial direction, and mounted in the inner section 30 of the central part, cooperates with the closure member 56. The stop bolt 58 is provided at its rear end with a pinion 59 and is screwed with a coarse thread in the inner section 30. The stop bolt 58 may be adjusted in longitudinal direction by means of an adjusting device, which is not shown in the drawing, and which engages the pinion 59 to therewith vary the moment of opening of the overflow valve 54, whereby regulation of the fuel injected into the combustion cylinder 14 is accomplished. The adjustment of the stop bolt 57 cooperating with the plunger 53 determines the start of the injection through the injection nozzle 45. The oil passes from the pump chamber 39 over a lateral slot 60 in the bore 50 and is pressed over the radial channel 48 and the central longitudinal bore 46 to the injection nozzle 45. After the closure member 56 of the overflow valve 54 is lifted by the adjustable stop bolt 58, the oil fed by the plunger 53 flows not any longer to the injection nozzle 45, but the oil flows back into the pump cylinder chamber 39. The stop bolt 58 determines therefore the length of time of fuel injection. Shortly before the end of the stroke of the piston 14 only the plunger 53 of small mass and the small mass closure member 56 of the overflow valve 54 are moved, without any necessary movable intermediate operating members. The plunger 53 and the closure member 56 can be built very light since sealing means are not necessary so that the there-occurring shock forces can be easily controlled. Proper seals are only necessary on the adjustable stop bolts 57 and 58.

FIG. 3 shows also the outer jacket 24 with the cooling chambers 25 which are flown through by the oil, as well as three symmetrically arranged channels 61 for the screws 36 which connect the two combustion cylinders 11 and 12 with the central part 10 of the engine. FIG. 3 also shows the lateral exhaust opening 62 of the combustion cylinder 11 and the lateral slits 63 for feeding scavenging air to the combustion cylinder 11. The openings 64 of the connecting conduit 65 for the common suction chamber 28 in the central part 10 of the engine are also visible in the lower cooling chambers 25.

The device for starting of the gas cushioned free piston type engine is not part of the present invention and therefore this device is neither illustrated nor described. There are various possibilities of starting the engine, not only by means of additional devices which act from the outside of the engine. In the pressure pulsation damper may for instance, depending on the amount of fuel injection, pressure variations occur which are between 10 bar to 100 bar. Depending on the medium motor piston pressure, which is produced, under consideration of the surface relationship of motor pistons to the pump piston, the oil pressure and the storage of oil is correspondingly high.

At a higher medium pressure, a larger amount of oil is simultaneously stored. This stored amount of oil can be used for starting the engine. Since for starting the engine a corresponding large amount of stored oil is present, the fuel regulating device is to be constructed in such a manner that a disconnection of the engine is only possible if a pressure indicating device has assumed a predetermined position.

It will be understood that each of the elements described above, or two or more together, may also find a useful application in other types of gas cushioned free piston type engine differing from the types described above.

While the invention has been illustrated and described as embodied in a gas cushioned free piston type engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for variosu applications without omitting features that, from the standpoint of prior art, fairly constitute essential characteristics of the generic or specific aspects of this invention.

What is claimed as new and desired to be protected by Letters Patent is set forth in the appended claims:

1. In a gas cushioned free piston type engine, a combination comprising a pair of oppositely arranged combustion cylinders axially spaced from each other; a central engine part having an inner section projecting with opposite end portions respectively into said combustion cylinders radially inwardly spaced therefrom and an outer section; piston means comprising a pair of pistons respectively arranged in said combustion cylinders;

common piston rod means rigidly connecting said pair of pistons of said piston means, said pistons having open ends of predetermined inner diameters facing each other; pump piston means having opposite faces impingeable by fluid and being fixedly mounted on said piston rod means, one of said means being eccentrically arranged with respect to the other of said means; a pump cylinder in which said pump piston means is reciprocable, said pump cylinder being arranged in said inner section of said central part, said opposite end portions of said inner sections of said central part having a smaller outer diameter than said predetermined inner diameter of each of said pair of pistons, and the stroke of the latter being such that said end portions of said inner section of said central part respectively extend into the open ends of said pistons during reciprocation of the latter.

2. A combination as defined in claim 1, and including a common suction chamber into which fluid is sucked by said pump piston means and a common pressure chamber, said common suction chamber and said common pressure chamber being arranged in a portion of said central part which projects radially beyond the outer diameter of said combustion cylinders.

3. A combination as defined in claim 2, wherein said common pressure chamber is located radially outwardly of said common suction chamber and has a volume considerably greater than that of said suction chamber.

4. A combination as defined in claim 3, wherein said common suction chamber and said common pressure chamber are constructed as concentric annular chambers.

5. A combination as defined in claim 4, and including a gas filled damping chamber and elastically yieldable walls respectively separating said gas filled damping chambers from said common suction chamber and from said common pressure chamber.

6. A combination as defined in claim 5, wherein said elastical yieldable walls separating said common pressure chamber from the respective damping chamber comprises a flexible membrane having parallel edges respectively clamped in said central part.

7. A combination as defined in claim 5, wherein said gas filled damping chamber is constituted by an annular tubular chamber arranged substantially concentric to and within said suction chamber.

8. A combination as defined in claim 3, including air inlet channels communicating with said combustion cylinders, a stationary outer housing surrounding said outer section of said central part, said combustion cylinders being fixedly connected to said central part and mounted for reciprocating movement relative to said stationary outer housing in the latter, said outer section of said central part having side faces extending transverse to said reciprocating movement and said stationary housing having side walls opposite said side faces and forming with the latter auxiliary chambers communicating with said air inlet channels of said combustion cylinders.

9. A combination as defined in claim 8, and including air inlet openings in said side walls of said stationary housing and air filter means for filtering the air passing through said air inlet openings.

10. A combination as defined in claim 1, wherein said pump cylinder forms together with said pump piston means and said opposite end portions of said inner section of said central part a pair of pump cylinder chambers, and including annular inlet and outlet valves located in said pump cylinder chambers and having an axis of symmetry parallel to that of said piston rod.

11. A combination as defined in claim 1, and including a pair of injection nozzles respectively located at opposite ends of said piston rod means for injecting fuel into said combustion cylinders, control means in said pump piston means for controlling the injection of fuel, and fuel passage means extending through said piston rod means and providing communication between said control means and said injection nozzles.

12. A combination as defined in claim 1, wherein said pump piston means is eccentrically arranged on said common piston rod means.

13. A combination as defined in claim 11, wherein said pump piston means is eccentrically arranged on said common piston rod means, and including a pair of blind bores extending from each of said opposite ends of said pump piston means into the latter, said control means comprising a spring biased plunger of small mass located in one of each pair of said blind bores, and an overflow valve having a spring biased closure member of small mass located in the other of each of said pair of blind bores.

14. A combination as defined in claim 13, and including stop bolts adjustably connected in longitudinal direction to opposite end portions of said inner section of said central part and respectively cooperating with the plungers and the closure members.

15. A combination as defined in claim 14, wherein said adjustable stop bolts for the overflow valves are provided at outer ends with means adapted to be connected with an operating device located outwardly of the engine for adjusting the axial position of the stop bolts for the overflow valves.

16. A combination as defined in claim 2, and including outer jackets respectively surrounding said combustion cylinders and forming with the latter cooling chambers, and conduits communicating with said common suction chamber through said cooling chambers.

* * * * *